US009121151B2

(12) United States Patent
Bergeron et al.

(10) Patent No.: US 9,121,151 B2
(45) Date of Patent: Sep. 1, 2015

(54) ADJUSTABLE SWEEPING BLADE DEVICE AND SWEEPING BLADE ASSEMBLY

(76) Inventors: Marco Bergeron, Asbestos (CA); Hugo Michel, Asbestos (CA); Stephan Michel, Asbesos (CA)

( * ) Notice: Subject to any disclaimer, the term of this patent is extended or adjusted under 35 U.S.C. 154(b) by 0 days.

(21) Appl. No.: 13/990,955

(22) PCT Filed: Nov. 30, 2011

(86) PCT No.: PCT/CA2011/001334

§ 371 (c)(1),
(2), (4) Date: May 31, 2013

(87) PCT Pub. No.: WO2012/075564

PCT Pub. Date: Jun. 14, 2012

(65) Prior Publication Data

US 2013/0239352 A1 Sep. 19, 2013

Related U.S. Application Data

(60) Provisional application No. 61/421,185, filed on Dec. 8, 2010.

(51) Int. Cl.
*E01H 5/06* (2006.01)

(52) U.S. Cl.
CPC . *E01H 5/06* (2013.01); *E01H 5/061* (2013.01)

(58) Field of Classification Search
CPC ..... E01H 5/06; E01H 5/061; E01H 5/062; E02F 3/8152
USPC ..... 37/196, 460, 233; 172/719, 772
See application file for complete search history.

(56) References Cited

U.S. PATENT DOCUMENTS

| | | | | | |
|---|---|---|---|---|---|
| 2,762,139 | A | * | 9/1956 | Launder | 37/453 |
| 2,884,082 | A | * | 4/1959 | Osterhaus | 172/719 |
| 3,084,750 | A | * | 4/1963 | Linden | 172/719 |
| 3,160,967 | A | * | 12/1964 | Nichols | 37/446 |
| 3,454,108 | A | * | 7/1969 | Skrukrud | 172/776 |
| 3,455,041 | A | * | 7/1969 | Roberts | 37/195 |
| 3,465,456 | A | * | 9/1969 | Meyer | 37/233 |
| 3,514,830 | A | * | 6/1970 | Takakita et al. | 29/891 |
| 4,159,584 | A | * | 7/1979 | Niemela | 37/241 |
| 4,166,640 | A | | 9/1979 | Van Denberg | |
| 4,305,272 | A | * | 12/1981 | Johnson | 148/640 |
| 4,307,523 | A | | 12/1981 | Reissinger et al. | |
| 4,669,205 | A | | 6/1987 | Smathers | |
| 4,711,187 | A | * | 12/1987 | Schultz | 111/123 |
| 5,456,323 | A | * | 10/1995 | Hill | 172/721 |

(Continued)

FOREIGN PATENT DOCUMENTS

| | | |
|---|---|---|
| DE | 7141159 | 7/1972 |
| DE | 10261421 A | 7/2004 |

(Continued)

OTHER PUBLICATIONS

PCT/International Search Report (ISR)—PCT/CA2011/001334 (Form PCT/ISA/220)—Feb. 22, 2012—4 pages.

*Primary Examiner* — Jamie L McGowan
(74) *Attorney, Agent, or Firm* — Benoit & Cote Inc.

(57) ABSTRACT

The present document describes a sweeping blade assembly comprising a blade portion comprising at least one bushing hole and a lower edge for sweeping a ground; a resilient material layer onto the blade portion; and a resilient material bushing in the bushing hole.

10 Claims, 7 Drawing Sheets

(56) References Cited

U.S. PATENT DOCUMENTS

| | | | | |
|---|---|---|---|---|
| 5,743,032 | A | 4/1998 | Vauhkonen | |
| 5,746,017 | A | 5/1998 | Marvik | |
| 5,881,480 | A * | 3/1999 | Fall | 37/460 |
| 6,145,858 | A | 11/2000 | Foulquier | |
| 6,922,924 | B2 * | 8/2005 | Jones et al. | 37/449 |
| 7,631,702 | B2 * | 12/2009 | Hansen | 172/604 |
| 7,665,234 | B2 * | 2/2010 | Diehl et al. | 37/266 |
| 8,191,287 | B2 * | 6/2012 | Winter et al. | 37/266 |
| 2003/0182824 | A1 * | 10/2003 | Coffin et al. | 37/266 |
| 2003/0188463 | A1 | 10/2003 | Manway et al. | |
| 2003/0221338 | A1 * | 12/2003 | Verseef | 37/266 |
| 2004/0177534 | A1 | 9/2004 | Jones et al. | |
| 2006/0070264 | A1 * | 4/2006 | Lachance et al. | 37/232 |
| 2007/0256334 | A1 * | 11/2007 | Schmeichel | 37/232 |
| 2009/0223090 | A1 | 9/2009 | Hunt | |
| 2009/0307934 | A1 * | 12/2009 | Wendorff et al. | 37/197 |
| 2013/0174452 | A1 * | 7/2013 | Diehl et al. | 37/233 |

FOREIGN PATENT DOCUMENTS

| | | | |
|---|---|---|---|
| DE | 102005040705 | A | 3/2007 |
| FR | 2539438 | | 7/1984 |

* cited by examiner

ADJUSTABLE SWEEPING BLADE DEVICE AND SWEEPING BLADE ASSEMBLY

CROSS-REFERENCE TO RELATED APPLICATIONS

This application claims priority under 35USC§119(e) of U.S. provisional patent application 61/421,185, filed on Dec. 8, 2010, the specification of which is hereby incorporated by reference.

TECHNICAL FIELD

This description relates to an adjustable sweeping blade device and an adjustable sweeping blade assembly for attachment to personal or commercial vehicles.

BACKGROUND

Removing snow from open ground, streets, sidewalks and parking lots is an age-old problem in less temperate climates where significant snowfall is anticipated during colder periods of the year. For instance, in many parts of Canada and in many northern states in the United States, significant snowfall can be expected during the late fall and early spring months.

Clearing freshly fallen snow from open ground, parking lots, driveways, sidewalks and roadways, whether these surfaces are paved or not, is a task common to all of these areas that is generally required to make these surfaces passable. If the snow is allowed to accumulate over a period of weeks, the snow eventually makes it difficult for pedestrian and vehicle travel, if not treacherous. Therefore, many devices have been designed and manufactured to remove accumulated snow from such surfaces.

Blade arrangements or systems for snow removal are typically mounted directly to a vehicle so as to remove snow and ice as from a wide variety of road surfaces. Depending of the environmental conditions, the type of road surface and the user ability that the snow plough blade arrangement is exposed to, the wear on the snow plough blade can be extensive and costly as the operator is constantly replacing the blades. Typically challenges for the blades include uneven road surface resulting in uneven/premature wear, repeated impact to the blades, hitting obstacles on the road, and operator error.

As an example, U.S. Pat. No. 5,746,017 issued May 5, 1998 to Jostein discloses a ploughshare having cutting edge and securing device for attachment to a plough. The ploughshare has a number of individual metalic parts which are firmly permanently embedded in an elastomer mass. The prior art however does not show the reduction of wear on snow blade systems as a result of the blades having constant metal to metal contact at different points in the attachment system.

As another example, U.S. Pat. No. 4,669,205 issued on Jan. 24, 1986 to Smathers and relates to a snow plough apparatus is described having segmented blade means comprising a plurality of bits. Each bit is independently mounted so that it can be vertically displaced when it encounters a high point in the roadway or an obstruction. It will be noted that such metal to metal contact results in an increase in wear and repair due to vibration which causes costs increase to the user of such a blade for removing snow from all kinds of roads and surfaces.

Also, U.S. Pat. No. 5,743,032 which issued on Apr. 28, 1998 to Vauhkonen relates to a plough blade arrangement for a snow-plough. The plough blade arrangement includes a frame consisting of a flat part removably attached to the plough, several blade plates covering the desired working width, and attachment members for the blade plates to the frame. Here, the prior art does not address the ability to accommodate uneven and different road surfaces. Moreover, the easy replacement of the blades is also not adequately addressed.

The prior art does not show the reduction of wear on snow blade systems as a result of the blades having constant metal to metal contact at different points in the attachment system. It will be noted that such metal to metal contact results in an increase in wear and repair due to vibration which causes costs increase to the user of such a blade for removing snow from all kinds of roads and surfaces.

Moreover, prior art does not completely address the ability to accommodate uneven and different road surfaces. Finally, the easy replacement of the blades is also not adequately addressed.

For these disadvantages established, there is therefore a need for an improved sweeping blade device.

SUMMARY

It is an object of the present disclosure to provide an improved adjustable sweeping blade device and an adjustable sweeping blade assembly for attachment to personal or commercial vehicles.

According to an embodiment, there is provided a sweeping blade device comprising a blade portion comprising at least one bushing hole and a lower edge for sweeping a ground; a resilient material layer onto the blade portion; and a resilient material bushing in the bushing hole.

According to another embodiment, there is provided a sweeping blade device, wherein the blade portion is made of composite material, steel, carbide, aluminum, alloy, polymer or plastic.

According to another embodiment, there is provided a sweeping blade device, further comprising an insert into the lower edge.

According to another embodiment, there is provided a sweeping blade device, wherein the insert is made of carbide.

According to another embodiment, there is provided a sweeping blade device, further comprising at least one bushing opposite to the lower edge of the blade portion.

According to another embodiment, there is provided a sweeping blade device, wherein the resilient material is a rubber material.

According to another embodiment, there is provided a sweeping blade device, wherein the resilient material bushing is integrally formed in the resilient material layers.

According to another embodiment, there is provided a sweeping blade device, wherein the resilient material bushing further comprises a metallic bushing.

According to another embodiment, there is provided a sweeping blade device, wherein the resilient material bushing further comprises a ventilation hole.

According to another embodiment, there is provided a sweeping blade kit comprising:

a) at least one blade support for removably attaching to a vehicle; and b) at least one sweeping device of claim 1 for removably attaching to the support.

According to another embodiment, there is provided a sweeping blade kit, wherein the blade support is made of two parts to receive the blade therebetween.

According to another embodiment, there is provided a sweeping blade, wherein the two parts are made of a first blade support for removably attaching to a vehicle and a second blade support for removably attaching to the sweeping blade device.

According to another embodiment, there is provided a sweeping blade assembly comprising:

a) at least one blade support for removably attaching to a vehicle; and b) at least one sweeping blade device removably attached to the blade support.

According to another embodiment, there is provided a sweeping blade assembly, wherein the blade support is made of two parts to receive the blade therebetween.

According to another embodiment, there is provided a sweeping blade assembly, wherein the two parts are made of a first blade support for removably attaching to a vehicle and a second blade support removably attached to the sweeping blade device.

According to another embodiment, there is provided a sweeping blade assembly, wherein the sweeping blade device is removably attached with attaching means.

According to another embodiment, there is provided a sweeping blade assembly, wherein the attaching means are nuts and bolts.

According to another embodiment, there is provided a sweeping blade assembly, wherein the vehicle may be included in the group consisting of a truck, a car, a four-wheeler, a tractor, a personal vehicle, a commercial vehicle, a snow plow vehicle and a van.

According to another embodiment, there is provided a sweeping blade assembly, wherein the blade support is for removably attaching to the front, side, back or underneath of the vehicle.

The expression "blade portion" is intended to mean a blade made of a material resilient or not. Examples include, without limitations, wide range of composite material, steel, carbide as defined below, aluminum, alloy, polymer, plastic, and the like.

The expression "carbide" is intended to mean a compound composed of carbon and a less electronegative element. Carbides can be generally classified by chemical bonding type as follows: (i) salt-like, (ii) covalent compounds, (iii) interstitial compounds, and (iv) "intermediate" transition metal carbides. Examples include, without limitations, calcium, carbide, silicon carbide, tungsten carbide (often called simply carbide), and cementite.

The expression "resilient material" is intended to mean a material which absorbs energy when it is deformed elastically and then, upon unloads to have this energy recovered. Examples include, without limitations, natural rubber, polymeric material, a wide range of composite material and the like.

The expression "rubber material" is intended to mean a material in which bond lengths deviate from the equilibrium (minimum energy) and strain energy is stored electrostatically. Examples include, without limitations, compositions of nitrile, hydrogenated nitrile, ethylene-propylene, fluorocarbon, chloroprene, silicone, fluorosilicone, polyacrylate, ethylene acrylic, styrene-butadiene, polyurethane, rubber material and the like.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed an improved adjustable sweeping blade device and an adjustable sweeping blade assembly for attachment to personal or commercial vehicles.

Figure 1:
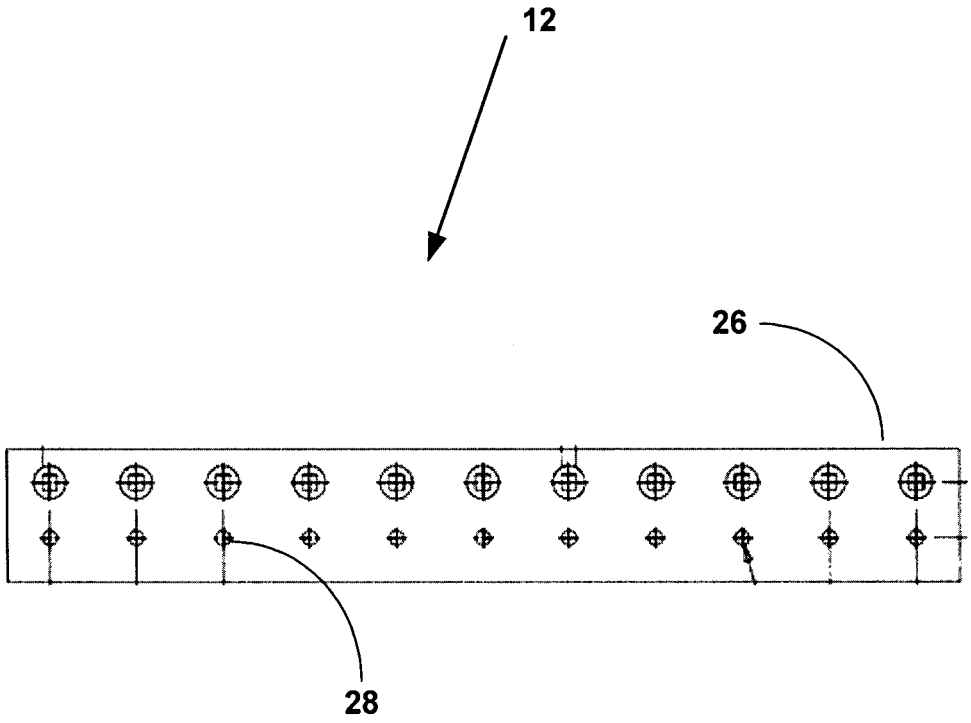
FIG. 1 illustrates the first blade support to be installed to a sweeping blade assembly for attachment to personal or commercial vehicles.
Figure 2:
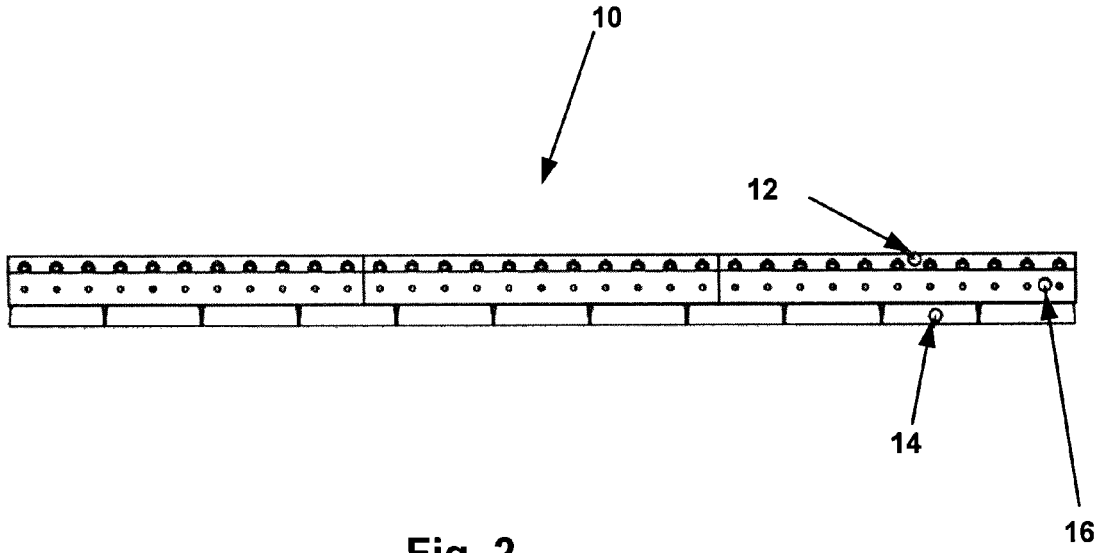
FIG. 2 illustrates an adjustable sweeping blade assembly for attachment to personal or commercial vehicles.

Referring now to the drawings, and more particularly to FIGS. 1 and 2, there is shown the first blade support 12 to be installed to a sweeping blade assembly 10 for attachment to personal or commercial vehicles. It is noted that the sweeping blade device 14 of the sweeping blade assembly 10 is removably attached with attaching means 28, such as nuts and bolts.

In FIG. 2, there is shown one embodiment of a sweeping blade assembly 10 comprising at least one blade support 12 for attachment to a vehicle. The sweeping blade assembly 10 also comprises at least one sweeping blade device 14 for attachment to a first blade support 12 and to at least a second blade support 16 for being attached to the sweeping blade device 14 and blade support 12 for sweeping a ground with resistant fixtures. Referring to the sweeping blade assembly 10, it is noted that the vehicle may be included in the group consisting of a truck, a car, a four-wheeler, a tractor, a personal vehicle, a commercial vehicle, a snow plow vehicle, a van and the like. The sweeping blade assembly 10 may be attached either to the front, back and underneath of such vehicles. This sweeping blade assembly 10 may be used to remove snow from road surfaces or even earth in an agricultural field.

Figure 3:
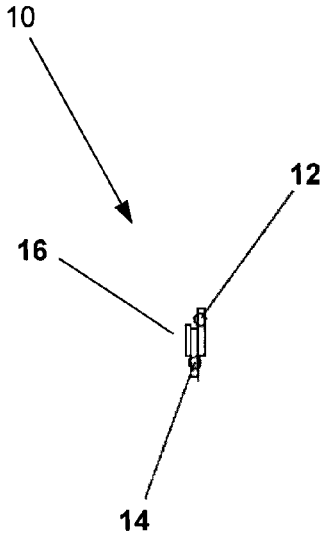
FIG. 3 is a cross-sectional view of an adjustable sweeping blade assembly for attachment to personal or commercial vehicles.

Now referring to FIG. 3, there is shown a cross-sectional view of a sweeping blade assembly 10 for attachment to personal or commercial vehicles. The sweeping blade assembly 10 comprises at least a first blade support 12 for attachment to a vehicle, at least one sweeping blade device 14 for attachment to a first blade support 12 and at least a second blade support 16 for being attached to the sweeping blade device 14 and blade support 12.

Figure 4:
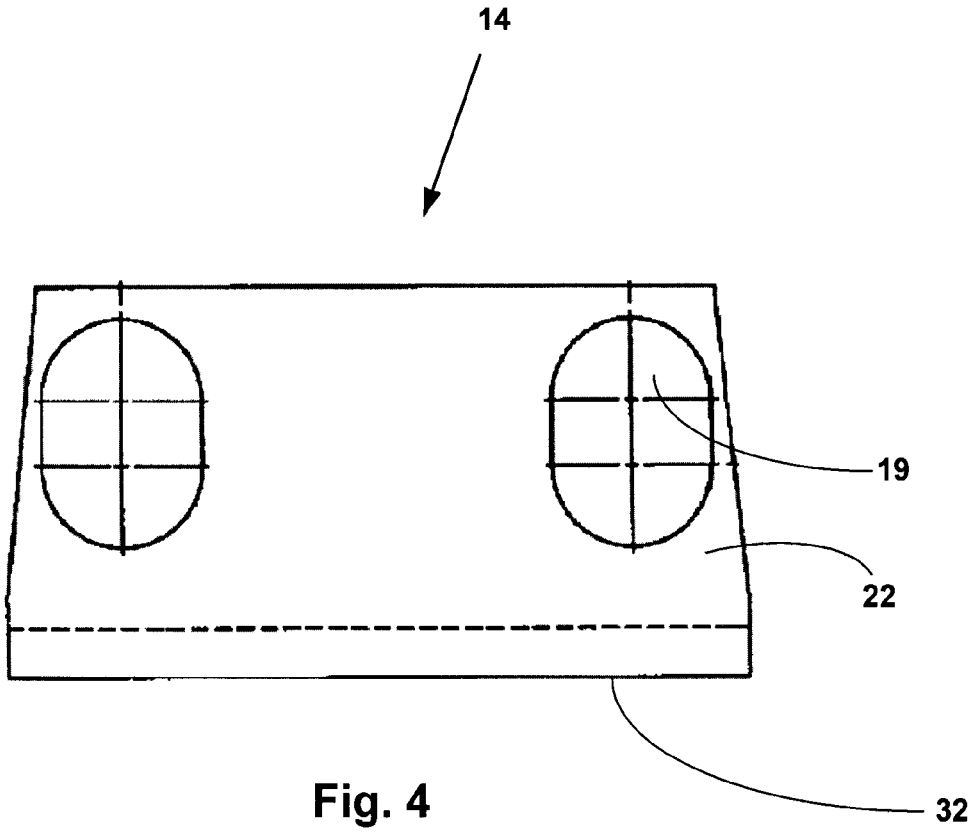
FIG. 4 illustrates an improved sweeping blade device to be installed to a sweeping blade assembly for attachment to personal or commercial vehicles.

Now referring to FIG. 4, there is shown a sweeping blade device 14 comprising a blade portion 22 which comprises a lower edge 32 for sweeping a ground.

Figure 5:
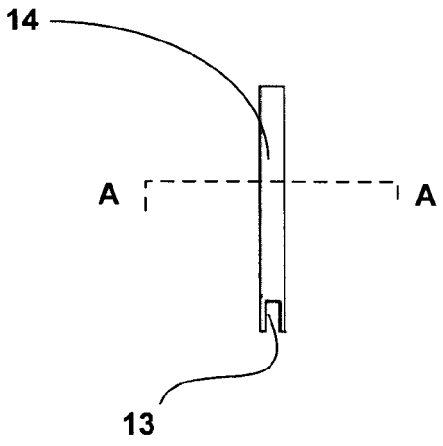
FIG. 5 is a cross-sectional view of an improved sweeping blade device to be installed to a sweeping blade assembly for attachment to personal or commercial vehicles.
Figure 6:
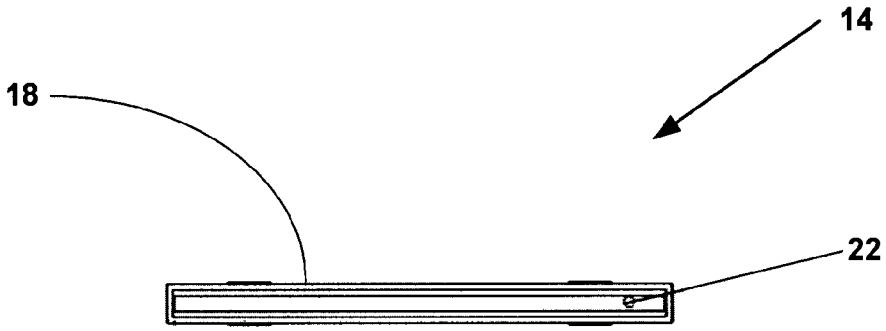
FIG. 6 is a cross-sectional view along axis A-A in FIG. 5 of an improved sweeping blade device showing the rubber blade portion to be installed to a sweeping blade assembly for attachment to personal or commercial vehicles.

In FIGS. 5 and 6, the blade portion 22 of the sweeping blade device 14 is coated with a layer 18 of a resilient material. As an example, the resilient material for the layer 18 may be made of rubber composition material.

It is to be noted that the sweeping blade device 14 include at least one bushing hole 19 opposite to the lower edge 32 (FIG. 4). The bushing 20 (FIG. 7) is made of a resilient material which may consist in a rubber composition material. It is to be noted that the bushing 20 and the bushing hole 19 allow a better absorption and the ability to accommodate uneven and different road surfaces without damaging the vehicle and the vehicle components. It is also to be noted that a metal to metal contact (without the bushing 20 and the bushing hole 19) results in an increase in wear and repair due to vibration which causes costs increase to the user of such a blade for removing snow from all kinds of roads and surfaces.

The bushing hole 19 may be of different shapes and/or configurations for increasing its ability to accommodate uneven and different road surfaces without damaging the vehicle and the vehicle components. The shape of the bushing hole 19 may be, without limitations, a circular shape, an elliptic shape, and the like. In a preferred embodiment, the shape of the bushing hole 19 is an eccentric shape.

Now referring to FIG. 5, there is shown a cross-sectional view of the improved sweeping blade device 14 to be installed to a sweeping blade assembly 10 for attachment to personal or commercial vehicles. There is shown a slot 13 for inserting an insert 15 as shown in FIG. 8

Now referring to FIG. 6, there is shown a cross-sectional view along axis A-A in FIG. 5 of the improved sweeping blade device 14 showing the layer 18 to be installed to a sweeping blade assembly 10 for attachment to personal or commercial vehicles.

Figure 7:
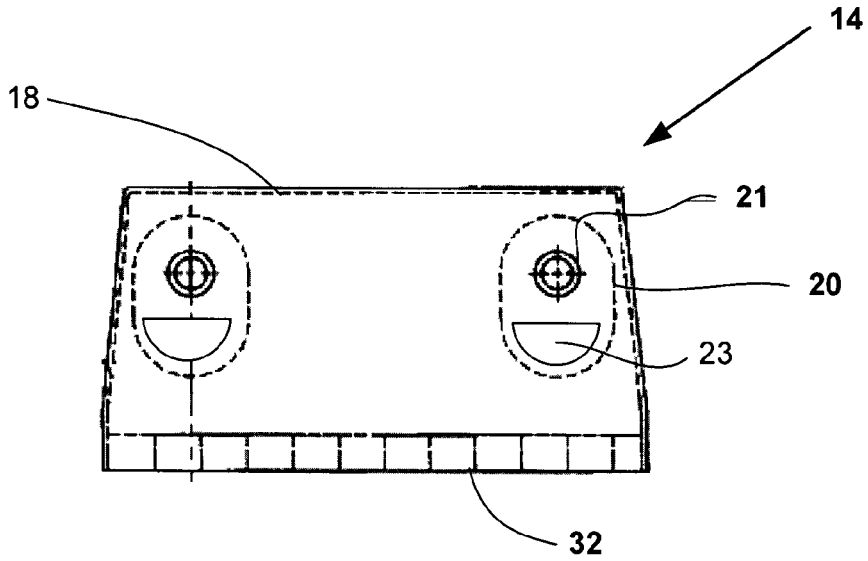
FIG. 7 illustrates the rubber blade portion with the bushings to be installed to a sweeping blade assembly for attachment to personal or commercial vehicles.

Now referring to FIG. 7, there is shown the layer 18 with the bushings 20 integrally formed thereto, for example, by molding. Metal bushing 21 is installed in resilient material bushing 20, as shown in FIG. 6. The resilient material bushing 20 allow metal bushing 21 to absorb vibration and vertical improvement causing less wear and tear on the lower edge 32. The ventilation hole 23 in layer 18 shown in FIG. 7 allow for more absorption of vibration and vertical movement of the sweeping blade device 14 reducing wear and tear on lower edge 32.

Figure 8:
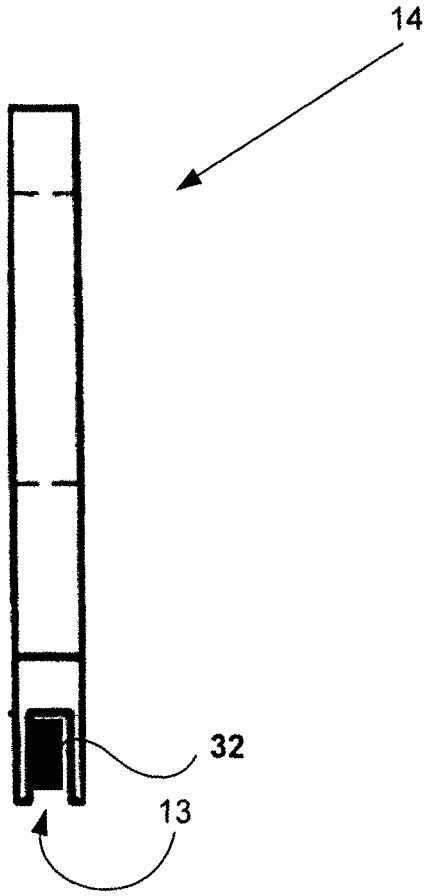
FIG. 8 is a cross-sectional view of an improved sweeping blade device with an insert to be installed to a sweeping blade assembly for attachment to personal or commercial vehicles.
Figure 9:
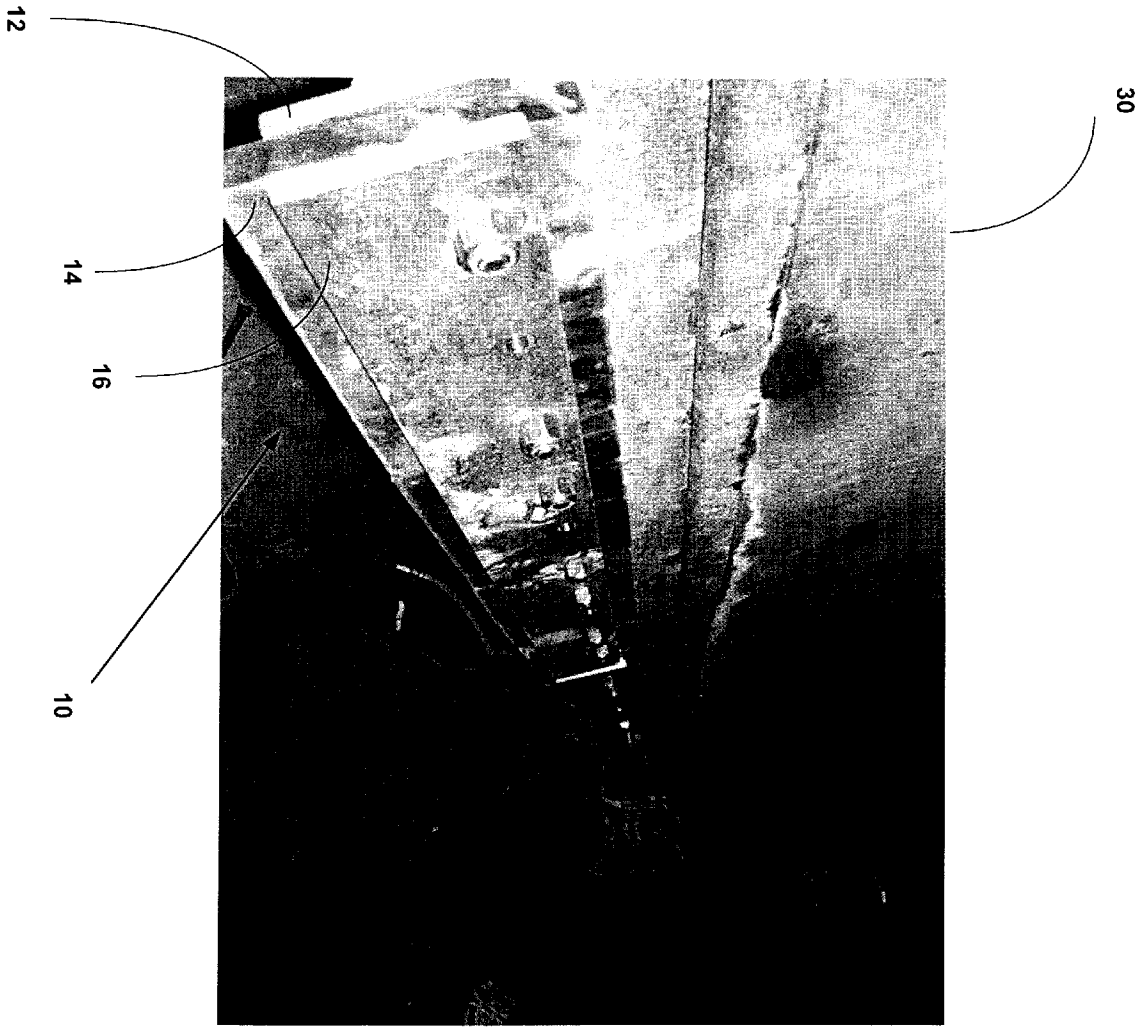
FIG. 9 shows the sweeping blade assembly for attachment to personal or commercial vehicles.
Figure 10:
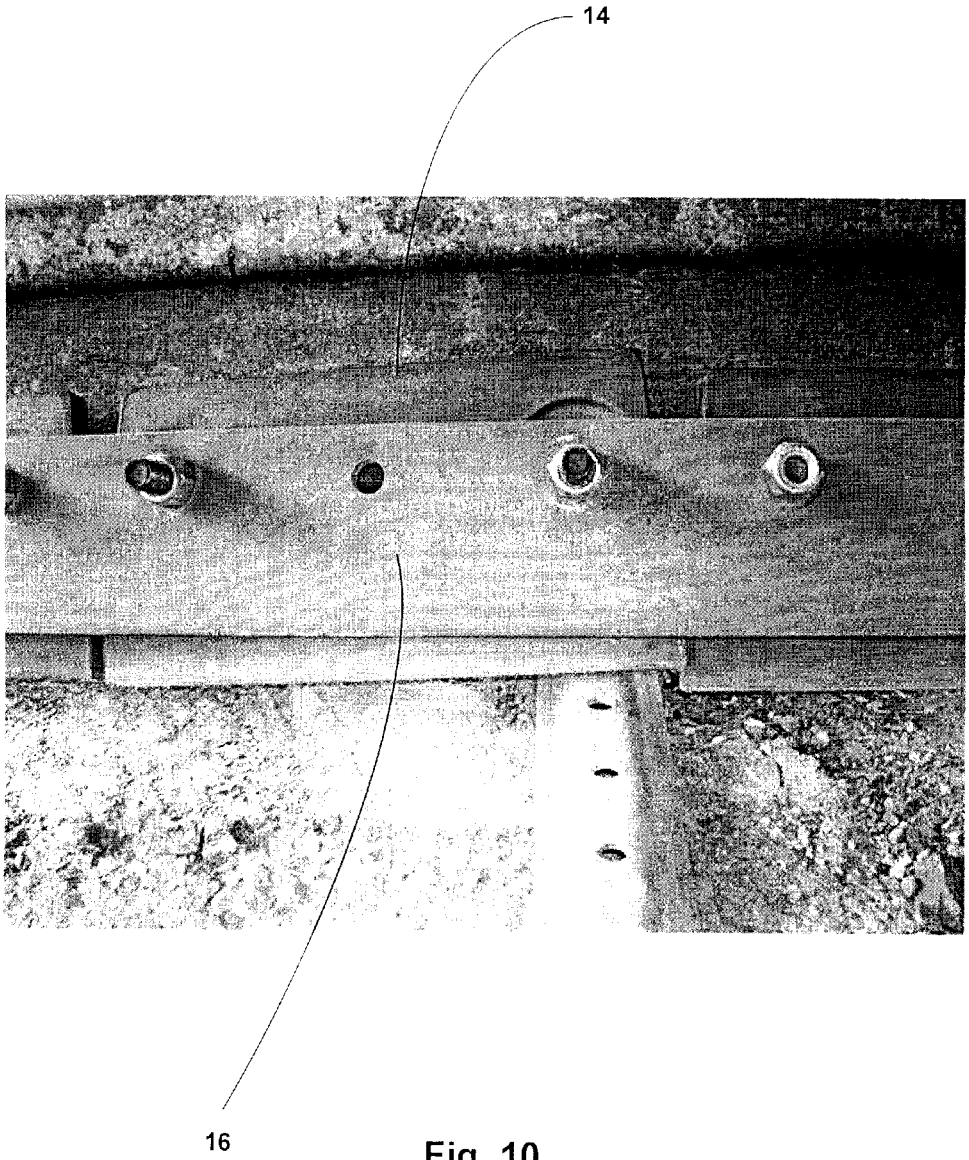
FIG. 10 is another view that shows the sweeping blade assembly for attachment to personal or commercial vehicles.

Still referring to the figures and now to FIG. 8 and FIG. 9, there is shown the sweeping blade assembly 10 for attachment to personal or commercial vehicles. In this case, the improved adjustable sweeping blade device 14 and the adjustable sweeping blade assembly 10 for attachment to personal or commercial vehicles can improve the methods of high speed snow removal by improving the wear life of the product, by minimizing vibrations on the equipments and the noise due to the roads surface contact effects, by reducing the fatigue encountered by the operator due to vibrations and noise, by improving roads and highways safety due to cleaner surfaces, by reducing sand and salt consumption and by reducing highways and roads marking wear.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A sweeping blade assembly comprising:

a first blade support adapted to be attached to a vehicle, said first blade support defining a first planar surface;

a second blade support defining a second planar surface, the second blade support being adapted to be attached parallel to and distant from the first blade support whereby the first planar surface and the second planar surface define a vertical channel for receiving sweeping blade devices; and a plurality of sweeping blade devices, each sweeping blade device comprising:

a blade portion comprising two bushing holes, a lower edge for sweeping a ground, and an upper edge opposite the lower edge;

a resilient material layer on said blade portion; and a resilient material bushing provided in each bushing hole and comprising a metal bushing for receiving a fastener for attaching the sweeping blade device to the first blade support and/or the second blade support;

wherein the vertical channel has an open top adjacent the upper edge of the blade portion and an open bottom adjacent the lower edge of the blade portion, and the resilient material bushing comprises an air gap for allowing vertical and angular movement of the sweeping blade device across the vertical channel.

2. The sweeping blade assembly of claim 1, wherein each blade portion is made of composite material, steel, carbide, aluminum, alloy, polymer or plastic.

3. The sweeping blade assembly of claim 1, wherein each blade portion further comprises an insert into said lower edge.

4. The sweeping blade assembly of claim 3, wherein the insert is made of carbide.

5. The sweeping blade assembly of claim 1, wherein the resilient material layer and the resilient material bushing are made of a rubber material.

6. The sweeping blade assembly of claim 1, wherein the air gap is a ventilation hole.

7. The sweeping blade assembly of claim 1, wherein the first blade support is removably attached to the vehicle.

8. The sweeping blade assembly of claim 1, wherein the vehicle may be included in the group consisting of a truck, a car, a four-wheeler, a tractor, a personal vehicle, a commercial vehicle, a snow plow vehicle and a van.

9. The sweeping blade assembly of claim 1, wherein the first blade support is for removably attaching to the front, side, back or underneath of said vehicle.

10. The sweeping blade assembly of claim 1, wherein the second blade portion is narrower than the sweeping blade devices.

* * * * *